US011317783B2

(12) United States Patent
Scalf et al.

(10) Patent No.: US 11,317,783 B2
(45) Date of Patent: May 3, 2022

(54) RETRACTING DISHWASHER RACK SYSTEM

(71) Applicant: Midea Group Co., Ltd., Foshan (CN)

(72) Inventors: Eric Scalf, Louisville, KY (US); Robert Digman, Goshen, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 49 days.

(21) Appl. No.: 16/882,044

(22) Filed: May 22, 2020

(65) Prior Publication Data

US 2020/0281442 A1 Sep. 10, 2020

Related U.S. Application Data

(62) Division of application No. 15/720,573, filed on Sep. 29, 2017, now Pat. No. 10,702,125.

(51) Int. Cl.

| | |
|---|---|
| ***A47L 15/50*** | (2006.01) |
| ***A47L 15/00*** | (2006.01) |
| ***A47L 15/42*** | (2006.01) |

(52) U.S. Cl.

CPC ..... *A47L 15/507* (2013.01); *A47L 15/0084* (2013.01); *A47L 15/4259* (2013.01); *A47L 15/4251* (2013.01)

(58) Field of Classification Search

CPC ..... A47L 15/507; A47L 15/0084; A47L 15/4259; A47L 15/4251

USPC ..... 134/56 D

See application file for complete search history.

(56) References Cited

U.S. PATENT DOCUMENTS

| | | | |
|---|---|---|---|
| 3,402,576 | A | 9/1968 | Krupsky |
| 3,466,105 | A | 9/1969 | Guth |
| 3,560,069 | A | 2/1971 | Doepke |
| 3,670,855 | A | 6/1972 | Lemery |
| 3,726,581 | A | 4/1973 | Doepke |
| 3,799,640 | A | 3/1974 | Jacobs |
| 3,892,453 | A | 7/1975 | Daily |
| 5,657,878 | A | 8/1997 | Austin |
| 5,860,716 | A | 1/1999 | Good et al. |
| 6,048,006 | A | 4/2000 | Antonucci et al. |
| 6,247,771 | B1 | 6/2001 | Miller |
| 7,296,830 | B2 | 11/2007 | Koveal et al. |
| 7,399,041 | B2 | 7/2008 | Prentner et al. |
| 7,410,228 | B2 | 8/2008 | Dickson et al. |
| 7,422,022 | B2 | 9/2008 | Maunsell et al. |
| 7,712,801 | B2 | 5/2010 | Xu et al. |
| 7,731,804 | B2 | 6/2010 | Gunnerson et al. |

(Continued)

FOREIGN PATENT DOCUMENTS

| | | | |
|---|---|---|---|
| CN | 101153449 | A | 4/2008 |
| CN | 101176640 | A | 5/2008 |

(Continued)

OTHER PUBLICATIONS

Korean Intellectual Property Office, Office Action issued in Application No. 10-2020-7004117, dated Apr. 12, 2021.

(Continued)

*Primary Examiner* — Tinsae B Ayalew

(74) *Attorney, Agent, or Firm* — Middleton Reutlinger

(57) ABSTRACT

A retracting rack for an appliance such as a dish washing appliance. The rack may be positionable between a stowed position and a deployed position. A spring may drive the rack towards the stowed position. A locking mechanism may be used to secure the rack in one or more positions.

22 Claims, 4 Drawing Sheets

(56) References Cited

U.S. PATENT DOCUMENTS

| | | | |
|---|---|---|---|
| 7,731,805 | B2 | 6/2010 | Banta et al. |
| 7,775,378 | B2 | 8/2010 | Tynes et al. |
| 7,947,943 | B2 | 5/2011 | Jaskol et al. |
| 8,061,790 | B2 | 11/2011 | Anikhindi et al. |
| 8,118,178 | B2 | 2/2012 | Olesiewicz et al. |
| 8,141,968 | B2 | 3/2012 | Velarde et al. |
| 8,166,983 | B2 | 5/2012 | Clerkin |
| 8,387,634 | B2 | 3/2013 | Dalsing |
| 8,511,769 | B2 | 8/2013 | Busalt et al. |
| 8,534,471 | B2 | 9/2013 | Wong et al. |
| 8,757,419 | B2 | 6/2014 | Schessl et al. |
| 8,757,742 | B2 | 6/2014 | McDaniel |
| 8,985,375 | B2 | 3/2015 | Kohles et al. |
| 9,055,851 | B2 | 6/2015 | Johansson |
| 9,241,604 | B2 | 1/2016 | Dries |
| 9,579,009 | B2 | 2/2017 | Bhajak et al. |
| 9,596,975 | B2 | 3/2017 | Bhajak et al. |
| 9,895,046 | B1 | 2/2018 | Wilson et al. |
| 2004/0104649 | A1 | 6/2004 | Muller et al. |
| 2004/0244825 | A1 | 12/2004 | Ashton |
| 2006/0237042 | A1 | 10/2006 | Weaver et al. |
| 2007/0039904 | A1 | 2/2007 | Purushothaman |
| 2008/0018215 | A1 | 1/2008 | Carden et al. |
| 2008/0129168 | A1 | 6/2008 | Banta et al. |
| 2009/0009040 | A1 | 1/2009 | Dellby et al. |
| 2010/0022339 | A1 | 1/2010 | Barve |
| 2010/0244642 | A1 | 9/2010 | Radusin et al. |
| 2011/0011678 | A1 | 1/2011 | Sheffield |
| 2011/0018410 | A1 | 1/2011 | Bastuji et al. |
| 2011/0180118 | A1 | 7/2011 | Schrott |
| 2012/0104914 | A1 | 5/2012 | Jobst |
| 2014/0083472 | A1 | 3/2014 | Baldwin et al. |
| 2014/0137911 | A1 | 5/2014 | Baldwin et al. |
| 2015/0374203 | A1 | 12/2015 | Hirsh et al. |
| 2016/0095498 | A1 | 4/2016 | Cho et al. |
| 2016/0270532 | A1 | 9/2016 | Gleixner et al. |
| 2016/0309982 | A1 | 10/2016 | Gerstner et al. |
| 2017/0027413 | A1 | 2/2017 | Gerstner et al. |
| 2017/0049295 | A1 | 2/2017 | Lagness et al. |
| 2017/0086584 | A1 | 3/2017 | Rehage |
| 2017/0224190 | A1 | 8/2017 | Sakthivel et al. |
| 2017/0273538 | A1 | 9/2017 | Kulkarni et al. |
| 2018/0140165 | A1 | 5/2018 | Roos et al. |
| 2019/0099057 | A1 | 4/2019 | Scalf et al. |

FOREIGN PATENT DOCUMENTS

| | | | |
|---|---|---|---|
| CN | 101558196 | A | 10/2009 |
| CN | 102658534 | A | 9/2012 |
| CN | 203341700 | U | 12/2013 |
| CN | 204378486 | U | 6/2015 |
| CN | 204608424 | U | 9/2015 |
| CN | 106343938 | A | 1/2017 |
| CN | 106691350 | A | 5/2017 |
| CN | 206390870 | U | 8/2017 |
| DE | 102007009540 | A1 | 8/2008 |
| DE | 102013017809 | | 4/2015 |
| DE | 102015207564 | A1 | 10/2016 |
| EP | 0848930 | A2 | 6/1998 |
| EP | 3085294 | A1 | 10/2016 |
| JP | H04218891 | A | 8/1992 |
| JP | H0533292 | U | 4/1993 |
| JP | 2001057955 | A | 3/2001 |
| JP | 2002345712 | A | 12/2002 |
| JP | 2008301921 | | 12/2008 |
| KR | 20030011496 | | 2/2003 |
| KR | 20090007094 | U | 7/2009 |
| WO | WO2013098009 | | 7/2013 |
| WO | WO2017174793 | A1 | 10/2017 |
| WO | WO2017200680 | A1 | 11/2017 |
| WO | WO2019061974 | A1 | 4/2019 |

OTHER PUBLICATIONS

Maytag, Maytag Dishwasher Upper Rack Adjuster Wheel Assy Right, www.amazon, Jul. 16, 2018.
Samsung, Dishwasher: Adjusting the Height of the Upper Rack, www.samsung.com, Jul. 16, 2018.
Transmittal of Related Applications.
Miele: AutoClose-Built-in Dishwasher. Apr. 6, 2017.
Electrolux: Pot & Pan Washer with Automatic Hood and Front/Side Feeding, Multi-Rack Support 833mm. Oct. 19, 2016.
Service Manual: Bottom Mount Refrigerators. Feb. 2005.
U.S. Patent and Trademark Office, Office Action issued in related U.S. Appl. No. 15/720,573 dated Sep. 12, 2019.
International Search Report and Written Opinion issued in Application No. PCT/CN2018/074299 dated Jun. 22, 2018.
U.S. Patent and Trademark Office, Office Action issued in related U.S. Appl. No. 16/214,778 dated Jun. 20, 2019.
International Search Report and Written Opinion issued in Application No. PCT/CN2019/097406 dated Oct. 31, 2019.
International Search Report and Written Opinion issued in Application No. PCT/CN2019/097434 dated Oct. 29, 2019.
International Search Report and Written Opinion issued in Application No. PCT/CN2019/097379 dated Oct. 30, 2019.
U.S. Patent and Trademark Office, Notice of Allowance issued in U.S. Appl. No. 15/720,573 dated Jan. 9, 2020.
U.S. Patent and Trademark Office, Notice of Allowance issued in related U.S. Appl. No. 16/214,778 dated Jan. 23, 2020.
U.S. Patent and Trademark Office, Notice of Allowance issued in U.S. Appl. No. 16/214,785 dated May 14, 2020.
Japanese Patent Office, Non-Final Office Action issued in Application No. 2020-511478, dated Mar. 23, 2021.
Japan Patent Office, Notice of Reasons for Refusal, issued in Application No. 2020-511478, dated Jun. 29, 2021.
U.S. Patent and Trademark Office, Notice of Allowance issued in U.S. Appl. No. 16/214,761 dated Nov. 29, 2021.
U.S. Patent and Trademark Office, Supplemental Notice of Allowance issued in U.S. Appl. No. 16/214,761 dated Oct. 25, 2021.
Korean Intellectual Property Office, Office Action issued in Application No. 10-2020-7004117, dated Oct. 23, 2021.
European Patent Office, Extended European Search Report issued in Application No. 19895143.6, dated Dec. 6, 2021.
U.S. Patent and Trademark Office, Notice of Allowance issued in U.S. Appl. No. 16/214,761 dated Sep. 30, 2021.
The State Intellectual Property Office of People's Republic of China, First Office Action issued in Application No. 201980078026.9, dated Jan. 24, 2022.

RETRACTING DISHWASHER RACK SYSTEM

BACKGROUND

The present embodiments relate to an appliance rack, drawer, or shelf, with particular embodiments shown for a dishwasher rack for a dishwasher appliance.

Typical dishwasher racks are pulled out and pushed back into place within the dishwasher tub, with the rack riding on rollers, wheels, glides, or rails. Occasionally, these racks are motorized to translate the movement of the dishwasher rack. However, this practice often may be expensive to implement and the environment (e.g. heat, cold, moisture, etc.) of the dishwasher tub may create a variety of challenges. Thus, there is a need for the dishwasher rack to be capable of retracting into the dishwasher tub with minimal or no motorization.

SUMMARY

In some embodiments of the invention, for example, a dish washing appliance may comprise a dishwasher tub including one or more rails having geared teeth. In various embodiments, the dish washing appliance may include a dishwasher rack having at least one elongated shaft and one or more torsion springs connected thereto, wherein the dishwasher rack is positionable between a stowed position in the dishwasher tub and a deployed position, wherein the deployed position is different from the stowed position. In some embodiments, the elongated shaft may include one or more geared wheels rotationally fixed to the shaft, wherein the one or more geared wheels and the shaft rotationally translate together along the geared teeth of the one or more rails between the stowed position and the deployed position. In addition, in various embodiments, the one or more torsion springs are secured to the shaft and wherein translating the dishwasher rack from the stowed position towards the deployed position rotates the shaft and correspondingly increases the spring force of the one or more torsion springs urging the dishwasher rack to return towards the stowed position.

In various embodiments, the dishwasher rack may further include a locking mechanism securing the dishwasher rack in the deployed position. In some embodiments, the locking mechanism may be a pawl and ratchet engagement. In various embodiments, the dishwasher rack may further include a gearbox, wherein the one or more torsion springs may be positioned within the gearbox. In addition, in some embodiments, the dishwasher rack may be an upper dishwasher rack. In various embodiments, the one or more torsion springs may be a spiral spring. Moreover, in some embodiments, the dishwasher rack may include a damper to slow the translation of the dishwasher rack from the deployed position towards the stowed position. In some embodiments, the dishwasher rack may further include a gearbox, wherein the damper may be positioned within the gearbox. In various embodiments, the damper may be a rotational damper attached to the elongated shaft, wherein the rotational damper may slow down the rotation of the shaft and the corresponding translation of the dishwasher rack from the deployed position towards the stowed position. In various embodiments, the dishwashing appliance may further comprise one or more slides connecting the dishwasher rack to the dishwasher tub.

In some embodiments, a dishwasher rack for a dish washing appliance may comprise a basket capable of occupying a stowed position the dish washing appliance. In various embodiments, one or more elongated shafts may be connected to the basket having one or more geared wheels fixed relative to the one or more shafts, the one or more geared wheels rotationally engaging one or more rails with corresponding geared teeth. In various embodiments, one or more torsion springs may be secured to the one or more shafts. In addition, in some embodiments, when the basket and the one or more shafts translate from the stowed position thereby rotating the one or more shafts relative to the one or more rails, tension in the one or more torsion springs may increase and urge the basket and the one or more shafts towards the stowed position.

In various embodiments, the dishwasher rack may further comprise a damper to slow the translation of the basket and the one or more shafts towards the stowed position. In some embodiments, the damper may be a rotational damper attached to the one or more elongated shafts. In various embodiments, the dishwasher rack may further comprise a locking mechanism. Moreover, in some embodiments, the locking mechanism may be a pawl and ratchet engagement. In various embodiments, the one or more torsion springs may be a spiral spring.

In addition, in various embodiments, a method of retracting a dishwasher rack towards a stowed position within a dish washing appliance may comprise the steps of providing a dishwasher rack having one or more torsion springs. In some embodiments, the method may include positioning the dishwasher rack from a stowed position to one or more deployed positions. In addition, in various embodiments, the method may include increasing the tension force of the one or more torsion springs when positioning the dishwasher rack from the stowed position towards the one or more deployed positions. In some embodiments, the method may include automatically retracting the dishwasher rack from the one or more deployed positions towards the stowed position.

In various embodiments, the method may include dampening the translation of the dishwasher rack from the one or more deployed positions towards the stowed position. In some embodiments, the method may include locking the dishwasher rack in the one or more deployed positions. In various embodiments, the method may include unlocking the dishwasher rack from the one or more deployed positions. In some embodiments, the dishwasher rack may include one or more geared elongated shafts rotationally engaging one or more rails with corresponding geared teeth. In addition, in some embodiments, the step of automatically retracting the dishwasher rack may include the one or more torsion springs rotating the one or more geared elongated shafts along the one or more rails.

These and other advantages and features, which characterize the embodiments, are set forth in the claims annexed hereto and form a further part hereof. However, for a better understanding of the embodiments, and of the advantages and objectives attained through its use, reference should be made to the drawings and to the accompanying descriptive matter, in which there are described example embodiments. This summary is merely provided to introduce a selection of concepts that are further described below in the detailed description, and is not intended to identify key or essential features of the claimed subject matter, nor is it intended to be used to limit the scope of the claimed subject matter, nor to define the field of endeavor.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
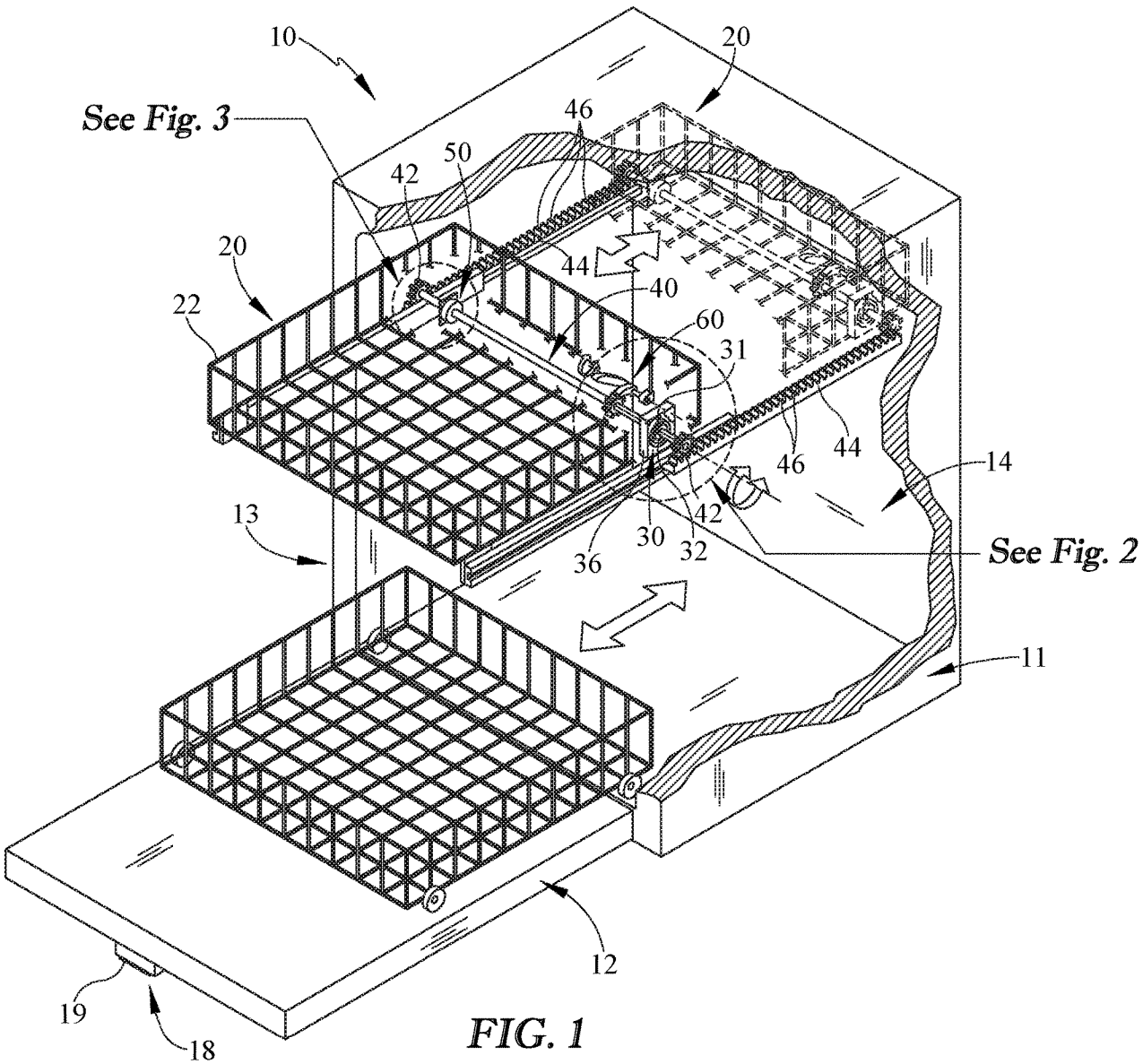
FIG. 1 is a perspective view of one embodiment of an upper dishwasher rack illustrating a deployed position and locking mechanism releasably securing the position of the rack, with portions of the housing, upper dishwasher rack, and dishwasher tub removed.

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described apparatus and techniques within a front-load residential dish washing machine such as dish washing appliance 10, such as the type that may be used in single-family or multi-family dwellings, or in other similar applications. However, it will be appreciated that the herein-described apparatus and techniques may also be used in connection with other types of dish washing machines in some embodiments. For example, the herein-described apparatus and techniques may be used in commercial applications in some embodiments. Moreover, the herein-described apparatus and techniques may be used in connection with other appliances, such as, for example, ovens, refrigerators, and the like. For example, one or more drawers for a bottom mount freezer of a refrigerator appliance may include the apparatus and techniques to auto-retract. Further, kitchen and/or bathroom shelves and cabinets may utilize the herein-described apparatus and techniques.

Embodiments for a dish washing machine are shown herein for ease of understanding. For example, a front-load dish washing machine that includes a front-mounted door 12 in a cabinet or housing 11 that provides access to a horizontally-oriented dishwasher rack 20 housed within the cabinet or housing 11 may be used. More specifically, the dishwasher rack 20 may be housed in a dishwasher tub 14. Implementation of the herein-described apparatus and techniques within a variety of appliances would be well within the abilities of one of ordinary skill in the art having the benefit of the instant disclosure, so the invention is not limited to the front-load dish washing implementation discussed further herein. For example, the apparatus and techniques may be used with a dishwasher drawer of a dish-washing appliance.

Turning now to the drawings, wherein like numbers denote like parts throughout the several views, FIG. 1 illustrates an example dish washing appliance 10 in which the various technologies and techniques described herein may be implemented. Dish washing appliance 10 is a front-load dish washing machine, and as such may include a front-mounted door 12 defining an opening 13 that provides access to a horizontally-oriented dishwasher tub 14. The door 12 may be coupled with a cabinet or housing 11 that may house the dishwasher tub 14 in some embodiments. Door 12 is generally hinged along a front or front edge of the housing 11 adjacent the opening 13 and is pivotable between the open position illustrated in FIG. 1 and a closed position (not shown). When door 12 is in the open position, dishes, utensils, pans, and other washable items may be inserted into and removed from the one or more dishwasher racks 20 through the opening 13 in the front of cabinet or housing 11. Control over dish washing appliance 10 by a user is generally managed through a control panel 18 disposed on a door 12 (not shown) and implementing a user interface 19, and it will be appreciated that in different dish washing machine designs, control panel 18 may include various types of input and/or output devices, including various knobs, buttons, lights, switches, textual and/or graphical displays, touch screens, etc. through which a user may configure one or more settings and start and stop the dishwasher rack cycle or movement as described herein. For example, the control panel, or portions thereof, may be included with the dishwasher rack, on the interior or exterior of the door, and/or adjacent the rack within the opening of the dish washing machine. For example in some embodiments, portions of the controls may be accessible when the door is in the open position. In other embodiments, the one or more racks may close/open, lock, and/or unlock from a position by proximity of one or more users and/or by a one or more gestures/forces or bodily movement relative to the rack and/or portions of the dish washing machine.

As shown in the figures, the one or more dishwasher racks 20, or portions thereof, may be positionable relative to the dish washing appliance 10 between a stowed or un-deployed position (illustrated in broken lines in FIG. 1) and a deployed or different position (illustrated in solid lines). At least one of the stowed positions of the dishwasher rack 20 may be used when one or more of the washing cycles is in operation. In use, the deployed position may be one or more horizontal positions different from one or more of the stowed positions. For example in one embodiment, one deployed position or partially opened position may be a position other than when the rack is in its fully extending position out of the dishwasher tub 14. One or more deployed positions may be a horizontal position to dry, load, and/or unload dishes, utensils, or the like. The one or more dishwasher racks 20 may travel in a substantially horizontal plane. The horizontal plane may be into and/or out of the dishwasher tub 14 or cavity. Although the substantially linear movement of the dishwasher rack cycle may occur along the horizontal plane as shown, the linear travel may be in a variety of angles and/or heights in one or both the directions into or out of a position.

As illustrated in the figures, the dishwasher rack 20 may be retractable to return towards the stowed position with reduced or no assistance by the user. The user has the ability to manually increase the spring/restore force of one or more torsion springs 30 when positioning the dishwasher rack 20 towards one or more deployed positions or away from the dishwasher tub 14. The torsion spring force or restore force of the torsion spring 30 drives/urges the dishwasher rack 20, or portions thereof, towards the stowed position. In the stowed position, the torsion spring 30 may be at rest or an untensioned state, or a less tensioned state than when in one or more deployed positions. When the user progressively forces the dishwasher rack 20 in a direction away from the dishwasher tub 14, the torsion spring 30 increases in tension to a one or more tensioned states, such that energy is stored within the torsion spring 30. The energy stored while pulling out the dishwasher rack 20 may automatically return/retract the dishwasher rack 20 back towards the stowed position and/or dishwasher tub 14 when released by the user. Alternatively, in some embodiments, the dishwasher rack 20 may be releasably secured/locked temporarily in one or more deployed positions until released towards the dishwasher tub 14 or one or more positions (e.g. the stowed position and/or deployed position more proximal to the dishwasher tub). Although the dishwasher rack spring may be a torsion spring 30, the spring may be a variety of constructions, shapes, sizes, quantities, and positions with the dishwasher rack. In some embodiments, the torsion spring may be a clock spring and/or coil spring. In a preferred embodiment, the torsion spring may be a spiral or clock spring as shown.

The dishwasher rack 20 may be the upper and/or lower dishwasher rack in some embodiments. In a preferred embodiment as shown, the dishwasher rack 20 is the upper dishwasher rack. The upper dishwasher rack may be pulled outward by the user, and upon release the dishwasher rack 20 may automatically retract back into the cavity, under the stored power of the torsion spring 30. In some embodiments, one or more portions of a dishwasher rack may be auto-retracted towards a stowed position within a dishwasher rack 20 and/or tub 14.

As illustrated in the figures, the torsion spring 30 stores energy/power to automatically retract the dishwasher rack 20 back towards the stowed position inside the dishwasher tub 14. The dishwasher rack 20 may include at least one axle or geared elongated shaft 40 with one or more geared or toothed engagements 42 engaging one or more slides, rail supports, or elongated rails 44 on the interior of the dishwasher tub 14. The geared engagement 42 between the shaft 40 and rail 44 reduces slipping and allows continuous rotation and translation of the shaft 40 relative to the rail 44. The torsion spring 30 may be secured to both the rotationally translating geared shaft 40 and to a remaining portion of the translating dishwasher rack 20. For example, the torsion spring 30 may be fixed at one end to the shaft 40 and the other end to the basket 22 and/or gearbox 36. As the shaft 40 and geared wheel 42 rotate together translationally along the elongated rail 44 of geared teeth 46 (e.g. when dishwasher rack is positioned towards the deployed position), the torsion spring 30 winds up thereby increasing the tension force or stored energy. It should be understood, the counter rotation of the shaft or axle 40 may correspondingly reduce the tension force in some embodiments.

Figure 2:
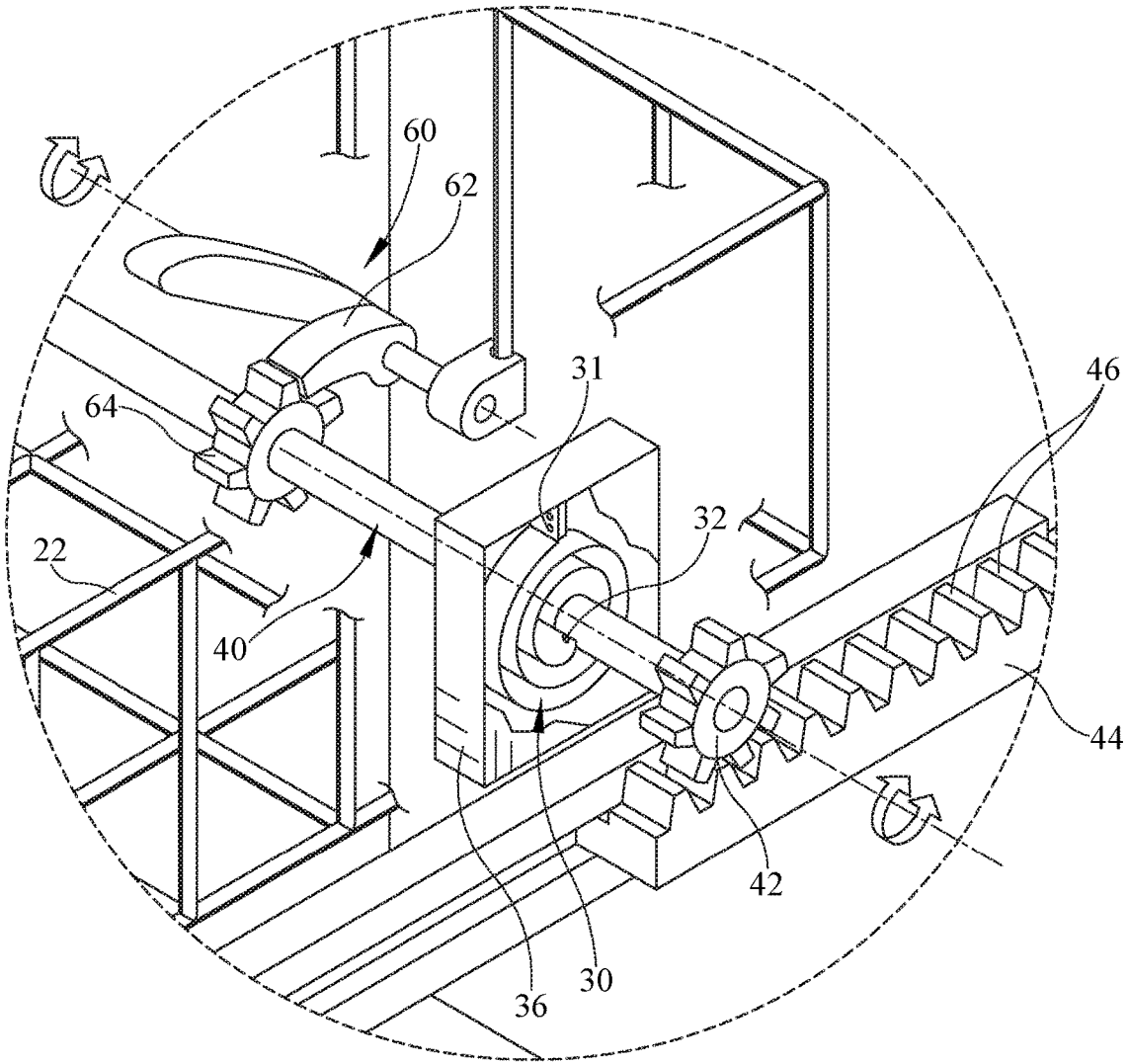
FIG. 2 is an enlarged perspective view of a portion of the dishwasher rack of FIG. 1 illustrating an embodiment of the torsion spring in a tensioned state and an embodiment of a locking mechanism.

In addition, in various embodiments, the dishwasher rack 20 may include a gearbox 36. The torsion spring 30 may be positioned within the gearbox 36 in some embodiments as shown in FIGS. 1 and 2. A fixed end 31 of the torsion spring 30, opposite a fixed end 32 attached to the shaft 40, may be secured to the gearbox 36, if used, in some embodiments. In some embodiments, the torsion spring 30 may be attached to the shaft 40 and a variety of other structure of the translating dishwasher rack 20. Although, one torsion spring 30 and/or one gearbox 36 is shown as being used in one embodiment, a plurality of springs 30 and/or gearboxes 36 may be used on one shaft 40 or a plurality of geared shafts 40. Although the torsion spring 30 may be shown in the gear box 36 in the embodiments, the torsion spring 30 may be combined with the one or more geared engagements or wheels 42 and/or the geared rail 44. For example, the gearbox 36 and torsion spring 30 may be internal within one or more geared slide rails within the dishwasher tub 14. Moreover, the gearbox 36 may be sealed (e.g. hermetically sealed) to reduce water and/or detergent from entering. In some embodiments, the gearbox 36 may also include one or more drains or weep holes to allow moisture to escape.

Figure 3:
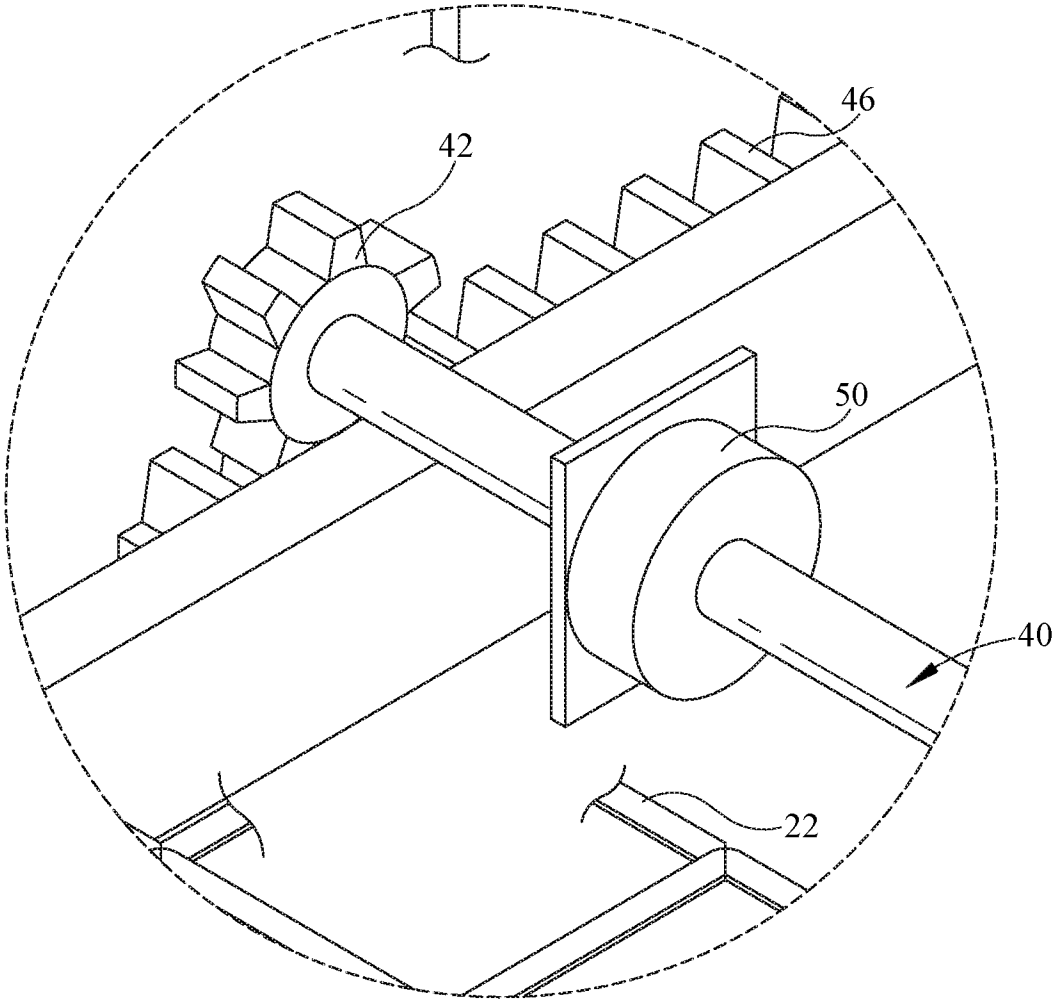
FIG. 3 is an enlarged perspective view of a portion of the dishwasher rack of FIG. 1 illustrating an embodiment of the damper.
Figure 4:
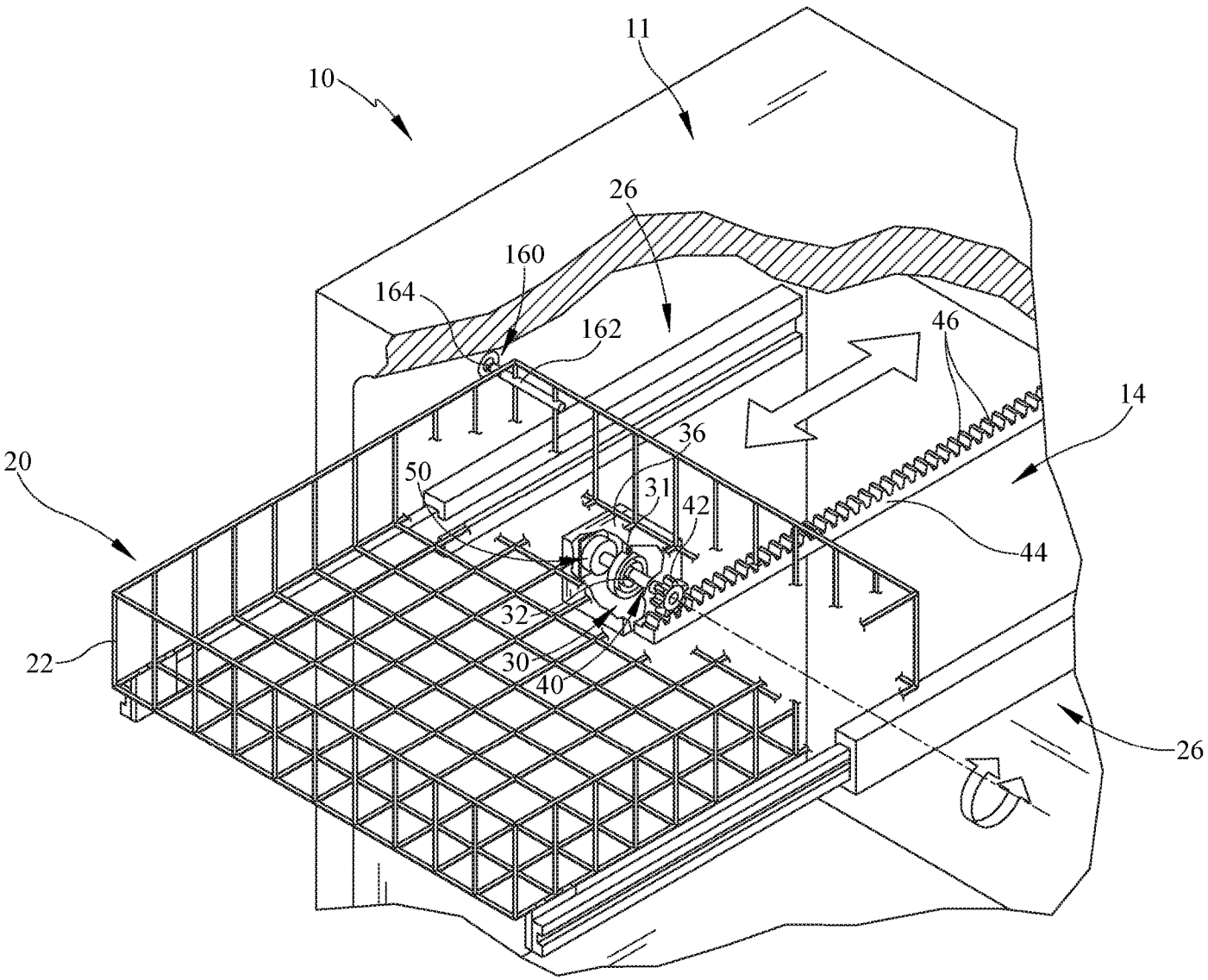
FIG. 4 is a perspective view of another embodiment of a dishwasher rack in a deployed position illustrating another embodiment of a locking mechanism releasably securing the position of the dishwasher rack.

As shown in FIGS. 1-4, an embodiment of the dishwasher rack 20 may include the elongated shaft 40 with one or more geared or toothed structures 42. As shown in FIGS. 1-3, the elongated shaft 40 may include two geared wheels 42. As illustrated in FIG. 4, the embodiment of the elongated shaft 40 includes one geared wheel 42 attached thereto. At least one geared wheel 42 may be rotationally fixed to the shaft 40. The elongated shaft 40 may include the geared wheel 42 adjacent to each opposing end thereof as shown in FIG. 1. The geared wheels 42, adjacent the opposing ends of the shaft 40, engage and rotationally translate along corresponding geared teeth 46 of each rail 44. With opposing geared wheels 42 having corresponding rotation with each other, the dishwasher rack 20 may reduce racking and/or twisting of the dishwasher rack or drawer. However, one geared wheel 42 at one of the ends of the elongated shaft 40 may be used. The one or more geared wheels 42 and/or rails 44 may be at a variety of locations along one or more shafts 40 and/or relative to the basket 22. Moreover, in some embodiments, the shaft 40 and geared wheels 42 may be the rear set on a dishwasher rack as shown or may be the front set, or both sets of contact with a geared rail.

Another embodiment of the dishwasher rack 20, as shown in FIG. 4, includes an elongated shaft 40 and at least one geared wheel 42. The geared engagement (e.g. between rail 44 and geared wheel 42) that winds-up the torsion spring 30 is in the central portion of the dishwasher rack 20 between opposing one or more slides 26 connecting the dishwasher rack 20 to the dishwasher tub 14. Moreover in various embodiments, the dishwasher rack 20 may include typical extensions, wheels, rollers, or glides adjacent the dishwasher tub 14 to allow the translation with respect thereto and still allow the auto-retract apparatus and techniques to be used.

In some embodiments, the dishwasher rack 20 may include one or more dampers or dampening devices 50. One or more dampers 50 may slow the translation of the dishwasher rack 20 from one position to another (e.g. into and/or out of the dishwasher tub, or from the deployed position to another position or stowed position). The damper 50 may limit the retracting speed to one or more values. In the embodiment shown in FIG. 3, the damper 50 is a rotational damper (e.g. friction or liquid) attached to the shaft 40 and/or basket 22. The rotational damper 50 may slow down the rotation of the shaft 40 and/or gear wheels 42 and correspondingly the translation of the dishwasher rack 20 in at least the direction towards the dishwasher tub 14 and/or stowed position. It should be understood that the dampers 50 may be a variety of constructions, quantities, positions, and sizes and still be within the scope of the invention. For example, the damper may be a linear damper (e.g. a mechanical spring or pneumatic cylinder). Moreover, as shown in FIG. 4, the damper 50 may be located within the gearbox 36 in some embodiments. The damper 50 and the torsion spring 30 may be attached to the shaft 40 and positioned within the gearbox 36 as shown in the embodiment.

In some embodiments, the dishwasher rack 20 may include a locking mechanism 60 securing the position of the dishwasher rack 20. The locking mechanism 60 may secure the dishwasher rack 20 in at least one deployed position. In various embodiments, the locking mechanism 60 may secure the dishwasher rack in the stowed position. One embodiment of the locking mechanism as shown in FIGS. 1 and 2 is a pawl 62 and ratchet 64 engagement. The pawl and ratchet engagement 62, 64 allows free motion in one rotational direction and provides a hard stop when turned the other rotational direction. For example, when the dishwasher rack 20 is pulled outward, the torsion spring 30 tightens to store energy, and the ratchet 64 and shaft 40 slips/rotates past the pawl 62. Moreover, when the user stops pulling and releases the dishwasher rack 20, the torsion spring 30 starts to urge/move the dishwasher rack 20 back towards the dishwasher tub 14, the pawl 62 will engage to the ratchet/shaft 64, 40 and hold the dishwasher rack 20 in the translational position. This locking feature 60 may work at the fully extended position as well as any position between the stowed and deployed position, as well as the stowed position in some embodiments. Releasing or lifting up on the handle/pawl 62 disengages or unlocks the shaft/ratchet 40/64 allowing the torsion spring 30 to auto-retract the dishwasher rack 20 back towards the dishwasher tub 14. In some locking mechanism embodiments, when the dishwasher rack is in the deployed position a spring loaded pin (not shown) may be released from its locked position to retract the dishwasher rack. The unlocked spring loaded pin would reset/return to the locked position or rest position upon return to the stowed position to subsequently reengage or lock the dishwasher rack upon positioning back to the deployed position. Another embodiment of a locking mechanism 160 is shown in FIG. 4. The locking mechanism 160 may be one or more catches 162 engaging one or more detent openings 164 when the dishwasher rack 20 reaches one or more deployed positions. In the preferred embodiment as shown, the catch 162 engages the detent opening 164 in the fully extended or deployed position. Although a handle or manual release may be used in some embodiments to disengage the locking mechanism, the user may push or pull the dishwasher rack 20 with sufficient force and distance in at least one direction (e.g. towards or away from the dishwasher tub and/or upwards/downwards) and release the catch 162 to engage the auto-retract feature and allow the torsion spring 30 to use the stored energy to position the dishwasher rack towards and/or to the stowed/home position. If a handle is used in some embodiments, the handle may stay released from the locking mechanism 60, 160 for sufficient time to allow the dishwasher rack 20 to return to the stowed position before reengagement. For example, a handle may be reset back (e.g. by a cam, spring, and/or damper) to the home position when reaching or approaching the stowed position.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A method of retracting a dishwasher rack towards a stowed position within a dish washing appliance comprising the steps of:

providing a dishwasher rack having one or more torsion springs positioned within one or more gearboxes;

positioning the dishwasher rack from a stowed position to one or more deployed positions;

increasing the tension force of the one or more torsion springs when positioning the dishwasher rack from the stowed position towards the one or more deployed positions; and automatically retracting the dishwasher rack from the one or more deployed positions towards the stowed position.

2. The method of claim 1 further comprising the step of dampening the retracting of the dishwasher rack from the one or more deployed positions towards the stowed position.

3. The method of claim 1 further comprising the step of locking the dishwasher rack in the one or more deployed positions.

4. The method of claim 3 further comprising the step of unlocking the dishwasher rack from the one or more deployed positions.

5. The method of claim 1 wherein the dishwasher rack includes one or more geared elongated shafts rotationally engaging one or more rails with corresponding geared teeth.

6. The method of claim 5 wherein the step of automatically retracting the dishwasher rack includes the one or more torsion springs rotating the one or more geared elongated shafts along the one or more rails.

7. The method of claim 1 further comprising the step of draining the one or more gearboxes.

8. The method of claim 1 wherein the one or more gearboxes is sealed.

9. A method of retracting a dishwasher rack towards a stowed position within a dish washing appliance comprising the steps of:

providing a dishwasher rack having at least one basket, one or more elongated shafts connected to the at least one basket having one or more geared wheels fixed to the one or more shafts, and one or more torsion springs secured to the one or more elongated shafts and positioned in one or more gearboxes, and wherein the one or more geared wheels rotationally engage one or more rails with corresponding geared teeth;

positioning the dishwasher rack from a stowed position to one or more deployed positions;

increasing the tension force of the one or more torsion springs when positioning the dishwasher rack from the stowed position towards the one or more deployed positions; and automatically retracting the dishwasher rack from the one or more deployed positions towards the stowed position.

10. The method of claim 9 further comprising the step of dampening the retracting of the dishwasher rack from the one or more deployed positions towards the stowed position.

11. The method of claim 10 wherein the dishwasher rack includes a damper to dampen the translation of the dishwasher rack.

12. The method of claim 11 wherein the damper is positioned within the one or more gearboxes.

13. The method of claim 9 further comprising the step of locking the dishwasher rack in the one or more deployed positions.

14. The method of claim 9 further comprising the step of unlocking the dishwasher rack from the one or more deployed positions.

15. The method of claim 9 wherein the dishwasher rack is an upper dishwasher rack.

16. The method of claim 9 wherein the one or more torsion springs are a spiral spring.

17. A method of retracting a dishwasher rack towards a stowed position within a dish washing appliance comprising the steps of:

providing a dishwasher rack having one or more torsion springs positioned within one or more gearboxes;

positioning the dishwasher rack from a stowed position to one or more deployed positions;

retracting the dishwasher rack from the one or more deployed positions towards the stowed position; and dampening the retracting of the dishwasher rack from the one or more deployed positions towards the stowed position.

18. The method of claim 17 further comprising the step of locking the dishwasher rack in the one or more deployed positions.

19. The method of claim 17 further comprising the step of unlocking the dishwasher rack from the one or more deployed positions.

20. The method of claim 17 further comprising the step of increasing the tension force of the one or more torsion springs when positioning the dishwasher rack towards the one or more deployed positions.

21. The method of claim 20 wherein the step of retracting the dishwasher rack includes the one or more torsion springs rotating one or more geared elongated shafts along one or more rails.

22. The method of claim 17 wherein the step of dampening may retract the dishwasher rack at one or more speed values.

* * * * *